United States Patent [19]

Engström et al.

[11] Patent Number: 4,630,412

[45] Date of Patent: Dec. 23, 1986

[54] COLLAPSE PREVENTING CONNECTION DEVICE FOR BUILDING STRUCTURES

[76] Inventors: Björn M. H. Engström, Guldringen 27, S-421 52 Västra Frölunda; Karl-Gustav Bernander, Ringvägen 32, S-133 00 Saltsjöbaden, both of Sweden

[21] Appl. No.: 704,248

[22] PCT Filed: May 30, 1983

[86] PCT No.: PCT/SE83/00216

§ 371 Date: Jan. 30, 1985

§ 102(e) Date: Jan. 30, 1985

[87] PCT Pub. No.: WO84/04773

PCT Pub. Date: Dec. 6, 1984

[51] Int. Cl.[4] ..... E04B 1/98; E04H 9/00

[52] U.S. Cl. ..... 52/1; 52/98; 52/99; 52/167; 52/232

[58] Field of Search ..... 52/1, 98, 99, 167, 232; 188/371, 377

[56] References Cited

U.S. PATENT DOCUMENTS

| | | | |
|---|---|---|---|
| 2,035,143 | 3/1936 | Cavaglieri | 52/167 |
| 3,198,288 | 8/1965 | Presunka | 188/377 |
| 3,232,012 | 2/1966 | Proctor | 52/1 |
| 3,308,908 | 3/1967 | Bunn | 188/374 |
| 3,736,712 | 6/1973 | Muto et al. | 52/167 |
| 3,794,277 | 2/1974 | Smedley et al. | 52/167 X |
| 3,866,367 | 2/1975 | Strizki | 52/98 |
| 3,913,707 | 10/1975 | Wastenson | 188/377 X |
| 4,166,344 | 9/1979 | Ikonomou | 52/98 X |
| 4,417,427 | 11/1983 | Bschorr | 52/167 |

FOREIGN PATENT DOCUMENTS

| | | | |
|---|---|---|---|
| 2283361 | 3/1976 | France | 188/377 |
| 717333 | 10/1954 | United Kingdom | 52/DIG. 4 |
| 554387 | 4/1977 | U.S.S.R. | 52/167 |

*Primary Examiner*—Alfred C. Perham

*Attorney, Agent, or Firm*—Pollock, Vande Sande & Priddy

[57] ABSTRACT

A connection device for building structures preventing progressive collapse. A pull means (1) incorporated in the device is adapted to be connected to a part of the structure by means of a cast compound that allows controlled slippage of the pull means at a tensile stress in the pull means which is below its ultimate tensile strength. The pull means is provided with an anchoring means (2) which after abutment against a stop means (3) stops slippage after a predetermined distance.

15 Claims, 21 Drawing Figures

COLLAPSE PREVENTING CONNECTION DEVICE FOR BUILDING STRUCTURES

FIELD OF THE INVENTION

The present invention concerns a connection device for building structures according to the preamble of claim 1.

BACKGROUND OF THE INVENTION

When erecting building structures of reinforced concrete and especially such containing precast units, not only the characteristic load values in the service and ultimate limit states should be considered, but also special regard should be paid to accidental loading (explosion, impact from vehicles, fire, seismic action, settlements of foundations, etc.), such that progressive collapse will be prevented in case of a local failure in the structure. In this connection, the available ductile capacity of the connections between the various structural units is of great importance. If it is sufficiently large, alternative load bearing paths can develop when the structure is deformed, energy is absorbed from dynamic action and the falling down of structural units is prevented.

Connections between various structural parts can have many forms. Common for most of them is, however, that they contain ties (tie means) anchored in the facing structural parts, and generally made of steel and having the ability to transfer tensile forces. When the structural units are made of reinforced concrete, the ties normally extend a distance into the structural parts where they are anchored.

Current technology normally uses connections which, with regard to the circumstances in case of accidental loading, have a limited ductile capacity before rupture occurs in the ties. Their capacity to absorb energy in case of dynamic action is also limited. The available ductile capacity essentially depends on the yielding capacity, the length and the bond distribution along the tie devices when their ultimate tensile capacity is reached at the joint interface.

Limited arrangements to minimize the risk of progressive collapse are thus often regarded as satisfactory, or the risks are diminished in other ways than by dimensioning the connections utilizing their ductility.

OBJECT OF THE INVENTION

The object of this invention, thus, is to disclose a tie arrangement providing tie connections between precast elements or other structural parts with a large ductile capacity which tie arrangement complementary to conventional ties possibly shall prevent a progressive collapse from occurring in case of accidental loading acting upon a building structure.

SUMMARY OF THE INVENTION

Using the invention, the ductile capacity of a connection may be designed at option choosing a tensile stress in the tie which is equal to or larger than that necessary for the transfer of forces due to design loading, but which is sufficiently lower than the ultimate tensile stress of the tie to prevent the risk for tensile failure by the slippage of end anchors of the tie through a material cast around the tie approximately at a predetermined stress in the tie between said limits, preferably between 60 and 90% of the ultimate tensile stress. According to the invention, the tie means includes one or more bars or wires of preferably high tensile steel having an ultimate tensile stress larger then 1000 MPa. In one or both of the connected structural parts, the tie means is surrounded by a cast material within a zone the length of which is equal to or greater than the predetermined length of possible displacement (distance of slippage). Preferably the length of said zone includes also the necessary anchoring length for anchoring the full tensile capacity of the tie. The tie is, at least at one of its ends provided with an end, anchor, for example a cold formed button head of such a size that the end anchor slips through the cast material at a predetermined tensile force within the tie.

One embodiment of the invention makes use of concrete or grout using cement as binding component for the cast material which surrounds the tie. For such materials it has been shown by tests that the end anchor starts to slip when the compressive stress between the end anchor and the cast material in the direction of the tie, i.e., on an area $A_a$=the projected cross section of the end anchor on a plane normal to the direction of the tie minus the cross section of the tie itself, is in the order 25–50 times the cylinder compressive strength of the cast material multiplied by a factor $$\left(\frac{\rho}{2400}\right)^2,$$

where $\rho$ is the density in kg/m$^3$ of the cast material. The supporting area of the end anchor $A_a$ against the cast material may be dimensioned according to the formula:

$$A_a = C\frac{A_s \cdot (f_{su} - \Delta f_{ST})}{k\left(\frac{\rho}{2400}\right)^2 \cdot f_{cc}}$$

where $A_s$ is the cross sectional area of the bar $f_{su}$ is the ultimate tensile stress of the bar $f_{cc}$ is the cylinder compressive strength of the cast material k is a constant which may vary between 25 and 50 dependent on the geometry of the end anchor and the composition of the cast material, for example the kind of aggregates being used, C is a factor that preferably is chosen between 0.6 and 0.8 and that expresses the ratio between the predetermined stress when slippage occurs, and the ultimate tensile stress of the tie $\rho$ is the density of the cast material which for cement based material mirrors the pore volume which seems to be the most important dimensioning parameter $\Delta f_{ST}$ is the decrease in stress in the bar as a result of bond between the joint interface and the end anchor.

The tie device according to the invention also includes means for stopping the slippage of the end anchor after a desired displacement so that the anchor capacity becomes larger than the force at which slippage occurs, whereby the full tensile capacity of the tie can be used and pullout from the structural part is prevented. These stopping means include, e.g., spiral wound wire, a tube provided with surface deformations, or a washer, which are placed around the tie along a relatively short length and which are cast in into the surrounding cast material within the zone where further slippage shall be prevented. Stopping means in the shape of spiral wound wire or a tube have the advantage of not stopping the slippage of end anchors suddenly but successively in case of dynamic action. Essentially the stopping means are placed within a zone around the plane of the bar. One effect of the use of said stopping means is that they enable utilizing the anchor displacements at both ends of a tie device which connects two facing structural parts. Another effect is that the ultimate capacity of the tie bar always can be made use of even in cases where the predetermined minimum force in the tensile tie should not be achieved due to any design error or default in execution or material.

The tie devices according to the invention can be given various configurations. They can be directly cast into the concrete in the same way as ordinary reinforcement in connection with the casting of the facing structural parts, or, in case tie devices are placed between precast structural units, in connection with the casting of said joints. The drawback of this method is that the strength and density of the concrete as well as the distribution of the course aggregate in the concrete normally varies such that the predetermined anchor slip load of the tie will vary correspondingly. An additional factor is that the material qualities of the structural concrete normally are governed by criteria other than those of current interest. By using the above mentioned means, however, the tie connection according to the invention provides a well functioning, progressive collapse preventing joint as a complement to conventional ties in the joint.

When connecting precast elements of concrete, the elements may be provided with holes or recesses into which tie devices according to the invention are introduced, the holes or recesses thereafter being grouted by injection or concreted with a material that is specifically composed for the purpose.

Tie devices according to the invention can also be prefabricated. The tie devices then include a pull bar and a cast material which may or may not be surrounded by a tubular means which is adapted to the specific use. Such precast tie devices, which are to be cast into concrete, are suitably provided with a surface suitable for anchoring in concrete, e.g., corrugation. The tubular means may, if they are to be cast into concrete, consist of spiral wound wire, spiral wound sheet metal tubes or the like, adding then the technical effect that splitting forces generated by the end anchor will not appreciably affect the structural concrete outside the tie device. In cases where the facing structural parts consist of steel, the tubular means is provided with sufficient material thickness to counteract current splitting forces caused by slip motion and for making welding connections possible. The inside diameter of the tubular means should, dependent on the density of the cast material (porosity), preferably be chosen at least two to three times the average outer diameter of the end anchor.

BRIEF DESCRIPTION OF THE DRAWINGS

The invention will now be described with reference to the attached drawings, wherein.

DETAILED DESCRIPTION

Figure 1:
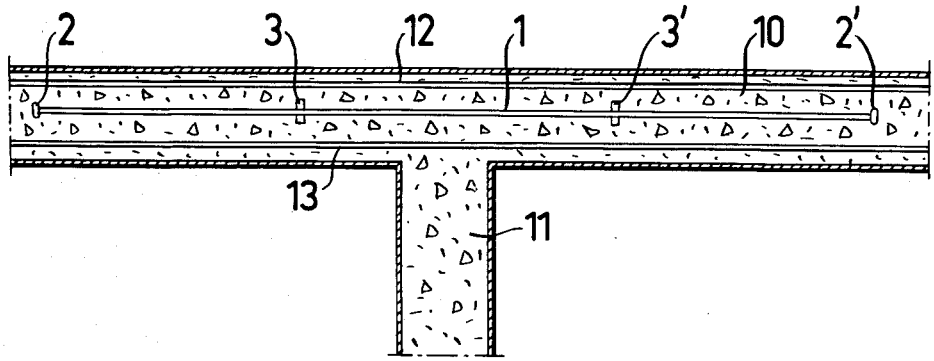
FIGS. 1 and 2 show a section through a part of a building structure provided with a tie device according to the invention before and after, respectively, an accidental loading.

FIG. 1 is a longitudinal section through a continous concrete slab (or beam) 10 which is supported by an interior wall or beam 11 as well as lateral supports (not shown) in the figure. The slab contains conventional top reinforcement 12 as well as some bottom reinforcement 13. In the concrete a tie device according to the invention is cast in which has the shape of a round bar 1 having formed button heads 2,2' at its ends and stop means in the shape of steel washers 3,3' placed at a distance from the support 11.

Figure 2:
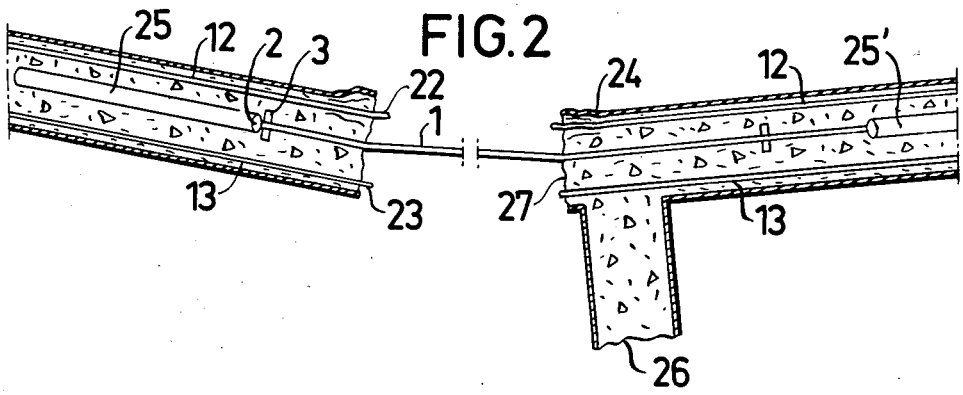

FIG. 2 shows the same slab structure as FIG. 1 after the support 11, e.g. by accidental loading at 26, has lost all its load carrying capacity. The slab at this stage is presumed still to be connected with the lateral supports which also may be provided with tie devices according to the invention. The figure shows that the slab now has broken near to the mid support at 27 and that the excessive load has led to breakage 22,23 of the conventional reinforcement 12 and 13. One of the end anchors 2 of the bar 1 has slipped in the surrounding concrete up to the stop means 3' forming a groove 25 behind it. The other end anchor 2' has also slipped, not necessarily all the way up to its stop means 3', however, and formed a groove 25' therebehind. At this stage the collapse may be stopped thanks to the fact that the tie device 1 has taken over the vertical supporting function of the damaged support 11.

Figure 3:
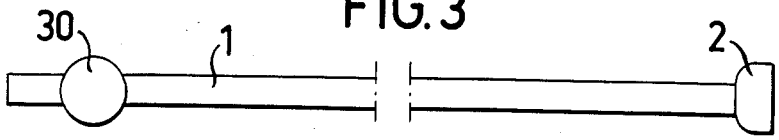
FIGS. 3 to 8 show examples of pull means according to the invention.

FIG. 3 shows a tie device in the shape of a cold-drawn bar 1 having formed heads at its ends, one head 2 being at the very end, the other head 30 being near the end, the diameter of the head being in the magnitude of 1.5 times the bar diameter.

Figure 4:
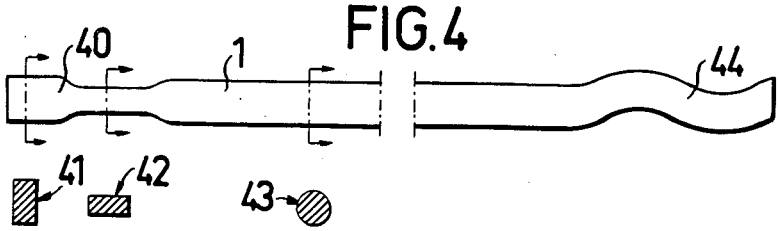

FIG. 4 shows alternative embodiments of anchor means at the ends of the bar 1. At 40 is shown how the originally circular cross-section 43 has been shaped by cross-wise upsetting in two mutually perpendicular planes 41 and 42, and 44 shows how the bar can be wave-shaped at its end.

Figure 5:
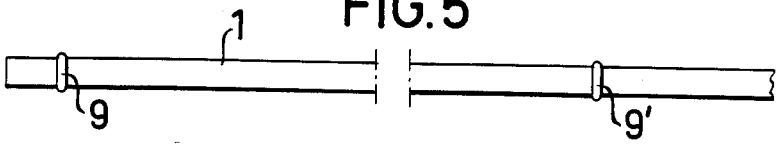

FIG. 5 shows how a round bar can be formed with ridges 9,9', e.g., by rolling, with a mutual distance of the same magnitude as the desired slip distance in the cast material surrounding the bar.

Figure 6:
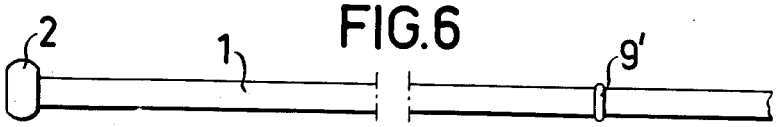

FIG. 6 shows how a ridged bar according to FIG. 5 can be provided with an upset head 2 at its end.

Figure 7:
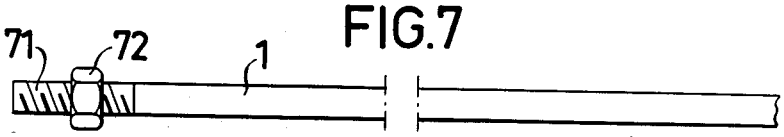

FIG. 7 shows a bar 1 having anchor means in the shape of a nut 72 threaded onto threads 71.

Figure 8:
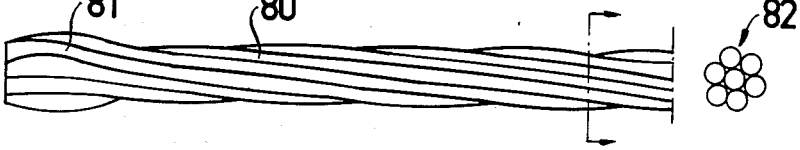

FIG. 8 shows a pull or draw means in the shape of a strand 80 of steel having a cross-section 82 and an anchor means in the shape of an upset head 81.

FIGS. 9–12 show longitudinal sections through prefabricated tie devices, including a bar 1 having end heads 2,2' and being entirely or on the major part of its length embedded in cast compound 4. Stop means 3,5 and 8, respectively, are provided at a distance equal to the desired length of deformation from the embedded end heads 2,2'.

Figure 9:
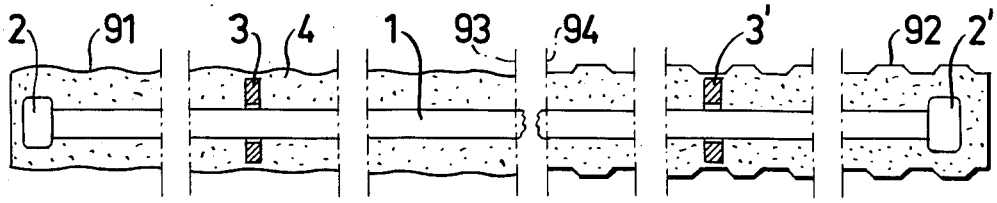
FIGS. 9 to 12 show examples of prefabricated tie devices according to the invention.

FIG. 9 shows a tie device where the cast material is formed with a corrugated surface 91 and a surface with recesses 92. Within the zone between sections 93 and 94 the bar may be free or embedded in cast compound 4. The stop means 3 comprises a steel washer having a center hole for the bar and an outer diamter substantially greater than that at the end head 2.

Figure 10:
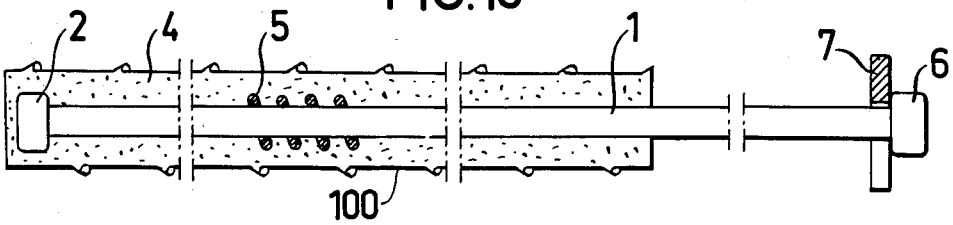

FIG. 10 shows a prefabricated tie device adopted for direct slip-free anchoring at one of its ends, numeral 6 denoting a head formed by jumping in that end and aubtting a U-shaped support washer 7 adapted to be connected to one structural part. The stop means 5 comprises a few turns of screwwound wire surrounding the bar 1. The cast compound 4, the bar 1 and the stop means 5 are confined by a spiral folded tube 100 adapted to co-operate with surrounding concrete.

Figure 11:
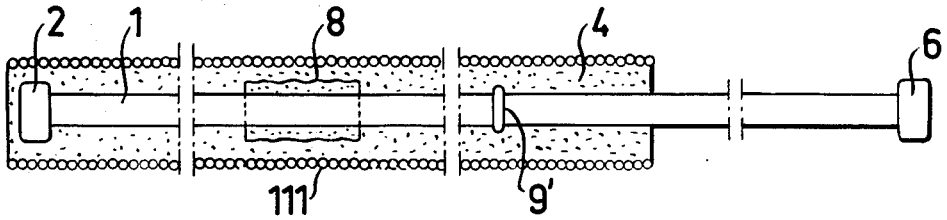

FIG. 11 shows a variant of surrounding tube comprising closely wound spiral wire 111 enabling bending of the connection device to some extent when it is mounted in a structural part. The stop means 8 comprises a short tube preferably having corrugated surface. In front of the stop means the bar is provided with a rolled ridge 9' having a smaller diameter than the end anchor 2.

Figure 12:
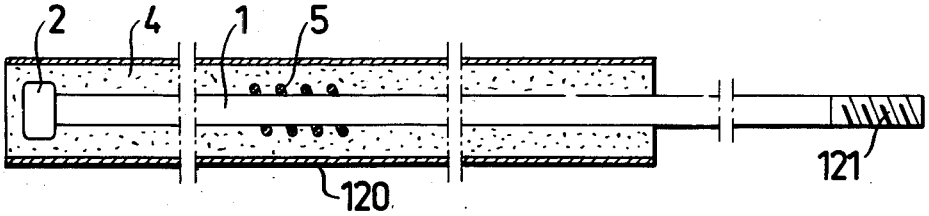

FIG. 12 shows a tie device similar to that according to FIG. 10 except for the facts that the surrounding tube 120 is adapted to be connected to a structural part of steel by welding and that the bar 1 is threaded at 121.

Figure 13:
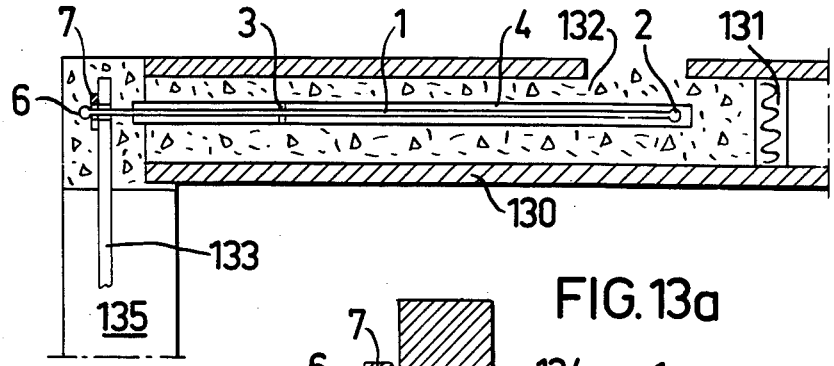
FIGS. 13 and 13*a* show an example of how a prefabricated tie element according to the invention can be arranged.
Figure 13A:
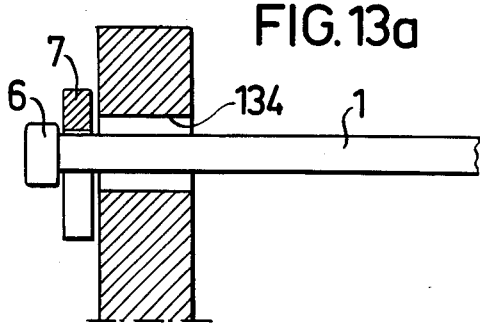

FIG. 13 shows how a flooring slab 130 provided with longitudinal holes (see cross-section 153 in FIG. 15) can be connected to a facade wall or support beam 135. The prefabricated tie device according to, e.g., FIG. 10 is fixed by casting on-site concrete 132 in one of the holes of the slab up to the mold 131. From the wall or beam 135 extends a connection means 133 anchored therein which may be a round or flat iron. In said iron there is a hole 134 having larger diameter than the anchor head 6 of the bar 1. The U-shaped intermediate washer 7 is put in place before the concrete 132 is cast.

Figure 14:
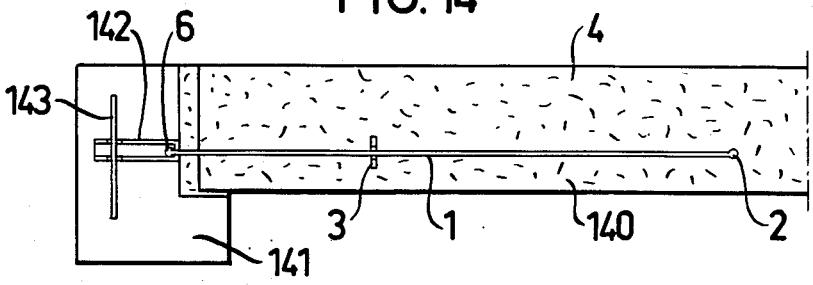
FIGS. 14 and 14*a* show an example of how a pull bar according to the invention can be arranged.
Figure 14A:
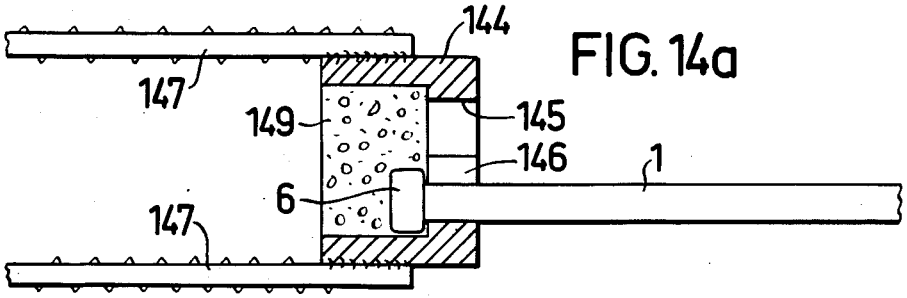
Figure 15:
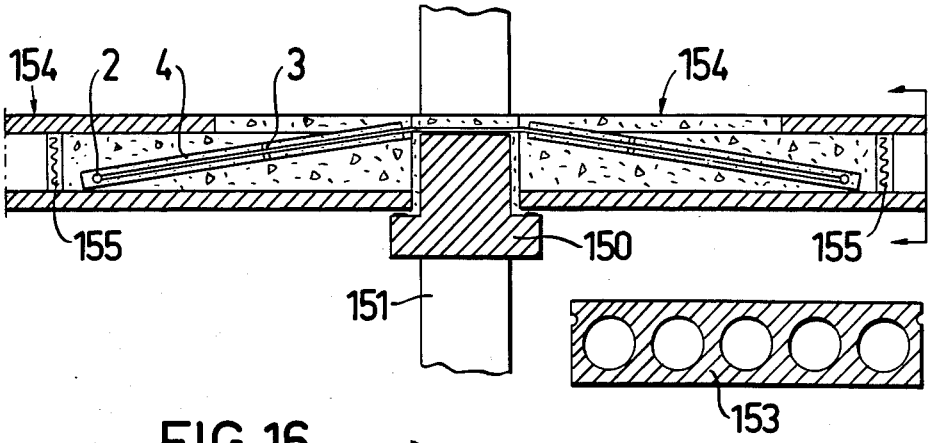
FIGS. 15 to 18 show examples of how prefabricated tie devices can be arranged for connecting different building parts.

FIG. 14 shows a longitudinal section through a joint between two flooring elements 140 (e.g., of the kind 153 of FIG. 15). In the joint is placed the bar 1 with end anchors 2 and 6 and stop means 3. The flooring elements 140 are resting on the support beam 141 in which, in the same longitudinal section as the joint, is cast in a steel tube 142 with anchoring means 143. Alternatively, the tube 142 can be made short, as 144 in FIG. 14*a*, which is anchored in the concrete by means of welded ribbed bars 147. The head 6 of the bar 1 is introduced in the aperture 145 in the end wall of the tube and is lowered into the slot 146 thereof. An elastic compound 149 filling the tube 144 ensures that the head 6 abuts the end wall. After the bar 1 has been located in the joint between the flooring elements and connected to the support beam 141, the joint is filled with concrete on-site.

Figure 16:
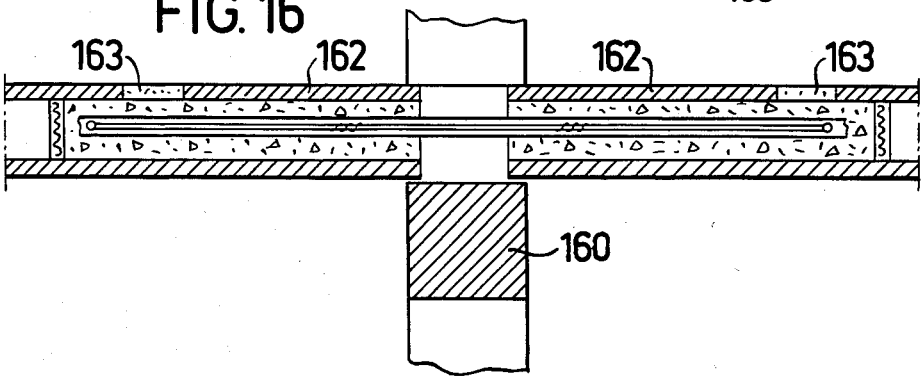

FIGS. 15 and 16 show how tie devices of e.g. the type according to FIG. 9 can connect prefabricated floorings 154 and 162, respectively, meeting at intermediary supports consisting of column supported beams 150 and 160, respectively. In both cases the flooring elements consist of hole elements 153 and the tie devices are connected by casting concrete in opposed holes, as in the construction according to FIG. 13.

Figure 17:
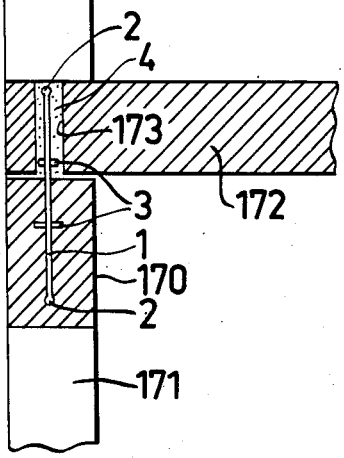

FIG. 17 shows an application where the tie device consisting of the bar 1 has one end anchorage 2 and stop washer 3 cast into the column supported beam 170 such that a portion of the bar 1 with its second end anchor 2 protrudes from the upper face of the beam. On that beam is mounted a flooring slab or beam 172 which is provided with a vertical hole 173 close to its end such that the hole surrounds the protruding portion of the beam 1. The hole is thereafter filled with mortar.

Figure 18:
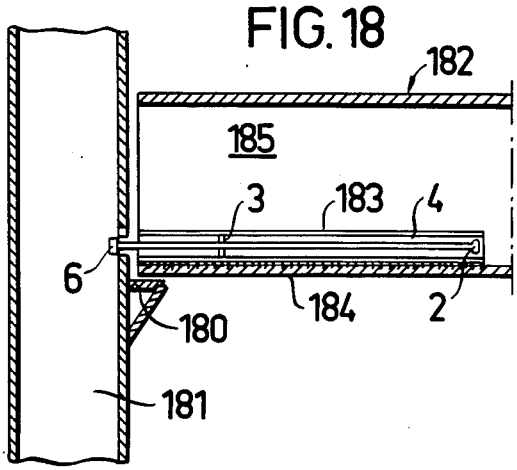

FIG. 18 shows a connection between a steel column 181 and a steel beam 182 having an I-profile. The column has a support bracket 180 on which the lower flange of the I-beam is placed. On one or both sides of the I-beam 182, there is a tie device according to, e.g., FIG. 12 welded to the lower flange 184 and the web 185. The end of the tie device having a jumped end head 6 is connected to the column by abutment according to the principle of FIG. 14*a*.

Figure 19:
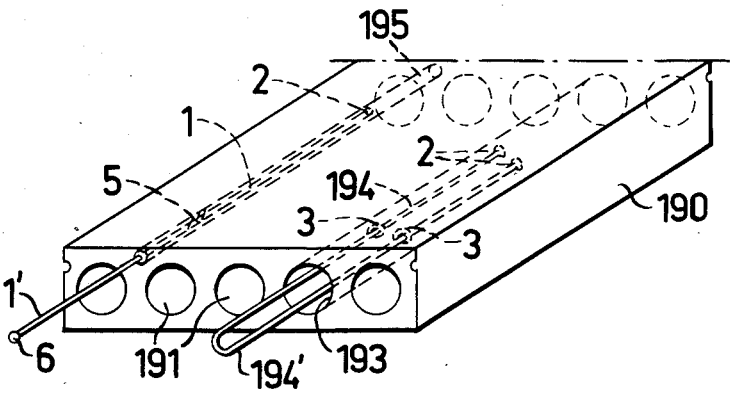
FIG. 19 shows two further examples of how the pull bar can be arranged in a concrete element.

FIG. 19 shows a hollow core slab 190 having a number of holes 191. At the time of manufacture, the hollow core slab can be provided with further longitudinal minor holes 195. A bar 1 having anchoring means 2 and stop means 5 is introduced in the hole 195 from one end thereof such that a portion 1' protrudes with its anchoring means 6 from the hole 195. Thereafter, a suitable casting compound is injected in the hole.

Another tie device 194 is bent to hairpin shape and introduced in a hole 193 so that the bent portion 194' protrudes from the element 190. Both legs of the tie means are provided with anchoring means 2 and stop means 3 and are fixed in the hole 193 by means of a casting compound.

We claim:

1. A tie device for building structures, adapted to connect structural elements and including at least one pull means having a first and a second end, and at least one anchoring means preferably adjacent to one of said ends, said anchoring means being surrounded by a cast material for connection to one of said structural elements, wherein said anchoring means (2,2') and said cast material (10) are so constituted that said anchoring means (2, 2') slides in said cast material when said pull means (1) is exposed to a tensional force that is less than its ultimate tensional strength and preferably greater than half its ultimate tensional strength, and wherein a stop means (3,3') is arranged in said cast material about said pull means in order to stop slippage after a predetermined slip distance by means of abutment of said anchoring means (2,2') against said stop means (3,3'), whereafter a higher tensional force than the slip force can be transmitted between said structural elements connected by said tie device.

2. A tie device according to claim 1, wherein said stop means is placed at a distance from an anchoring means such that the entire ultimate strength of said pull means can be transmitted to a structural element within that distance.

3. A tie device according to claim 1, wherein said pull means is connected to one structural element without possibility of slippage and such that the entire ultimate tensile strength of said pull means can be anchored there.

4. A tie device according to any one of claims 1 to 3, wherein said pull means comprises a round bar having anchoring means adjacent its ends.

5. A tie device according to claim 4, wherein said anchoring means comprise heads abutted adjacent to the ends.

6. A tie device according to claim 2 or 3, wherein said pull means comprises cold drawn wires twisted to a strand provided at its ends with abutted heads.

7. A tie device according to claim 4, wherein said pull means, seen in the pull direction, passed said stop means has at least one further anchoring means having less anchoring capacity relative to said cast material in the pull direction than the added anchoring capacity of the anchoring means behind said stop means.

8. A tie device according to any one of claims 1 to 3, characterized in that it is a prefabricated assembly of one or more pull means and a material cast therearound, said material being arranged for direct or indirect connection to a structure.

9. A tie device according to claim 8, wherein portions of said pull means that are surrounded by cast material are adapted for co-operation with concrete.

10. A tie device according to claim 8, wherein said pull means is surrounded by cast material in a tubular means, which is adapted to be connected to a structure.

11. A tie device according to claim 10, wherein said tubular means comprises a steel tube which may be connected to a steel structure by welding.

12. A tie device according to any one of claims 1 to 3, wherein said stop means comprises steel washers surrounding said pull means and having a greater abutment area against said cast material than said anchoring means.

13. A tie device according to any one of claims 1 to 3, wherein said stop means comprise a few turns of screw wound wire, or a short tube, surrounding said pull means.

14. A tie device according to claim 3, wherein the anchoring means of said pull means is directly connected by abutment against means fixedly connected to a structural part.

15. A building structure having a tie device according to any one of claims 1 to 3, wherein said pull means and its associated stop means are cast in their predetermined position at the time of casting, concrete topping or jointing of connected structural parts or elements.

* * * * *